United States Patent [19]

Branovich et al.

[11] Patent Number: 4,911,626

[45] Date of Patent: Mar. 27, 1990

[54] METHOD OF MAKING A LONG LIFE HIGH CURRENT DENSITY CATHODE FROM TUNGSTEN AND IRIDIUM POWDERS USING A MIXTURE OF BARIUM PEROXIDE AND A COATED EMITTER AS THE IMPREGNANT

[75] Inventors: Louis E. Branovich, Howell; Bernard Smith, Ocean; Gerard L. Freeman, Freehold; Donald W. Eckart, Wall, all of N.J.

[73] Assignee: The United States of America as represented by the Secretary of the Army, Washington, D.C.

[21] Appl. No.: 439,135

[22] Filed: Nov. 20, 1989

[51] Int. Cl.[4] ..... B22F 3/26

[52] U.S. Cl. ..... 419/27; 419/28; 419/29; 419/33; 419/39; 419/54; 419/55; 419/58

[58] Field of Search ..... 419/27, 28, 29, 33, 419/39, 54, 55, 58

[56] References Cited

U.S. PATENT DOCUMENTS 4,818,480 4/1989 Branovich et al. ..... 419/27

4,890,767 6/1989 Branovich et al. ..... 419/27

*Primary Examiner*—Stephen J. Lechert, Jr.

*Attorney, Agent, or Firm*—Michael Zelenka; Roy E. Gordon

[57] ABSTRACT

A long life high current density cathode is made from a mixture of tungsten and iridium powders by processing the mixture of powders with an activator into a porus billet, and then impregnating the billet with a mixture of barium peroxide and a coated emitter by firing the billet in a dry hydrogen furnace at a temperature at which the impregnant melts.

10 Claims, No Drawings

METHOD OF MAKING A LONG LIFE HIGH CURRENT DENSITY CATHODE FROM TUNGSTEN AND IRIDIUM POWDERS USING A MIXTURE OF BARIUM PEROXIDE AND A COATED EMITTER AS THE IMPREGNANT

The invention described herein may be manufactured, used and licensed by or for the Government for governmental purposes without the payment to us of any royalty thereon.

This invention relates in general to a method of making a long life high current density cathode and in particular to a method of making such a cathode from a mixture of tungsten and iridium powders using a mixture of barium peroxide and a coated emitter as the impregnant.

BACKGROUND OF THE INVENTION

In U.S. Pat. No. 4,818,480 issued Apr. 4, 1989, there is disclosed and claimed a method of making a cathode from a mixture of tungsten and iridium powders using a barium peroxide containing material as the impregnant. Such a material can be barium peroxide alone or a mixture of barium peroxide with iridium or a mixture of barium peroxide with osmium, or a mixture of barium peroxide with rhodium. Though cathodes made by the method of U.S. Pat. No. 4,818,480 deliver adequate energy densities, it would be desirable to provide cathodes which deliver even higher energy densities.

SUMMARY OF THE INVENTION

The general object of this invention is to provide an improved method of making a long life high density cathode. A more particular object of the invention is to provide such a method that will be an improvement over the method of U.S. 4,818,480. A still further object of the invention is to provide such a method by better controlling surface to surface contact of particles as well as particle size and by coating particles prior to impregnation allowing maximum surface to surface reaction.

It has now been found that the aforementioned objects can be obtained by providing a method of making a long life high current density cathode suitable for application in microwave devices by making a porous billet from tungsten and iridium powders and then using a mixture of barium peroxide and a coated emitter as the impregnant for the billet.

The particular emitter used for the impregnant must have a long cathode life of thousands of hours. Suitable emitters include $Ba_3Al_2O_6$, $Ba_3WO_6$, 4/1/1 $4BaO/1CaO/Al_2O_3$, and 5/1/2 $5BaO/1CaO/2Al_2O_3$. The particular emitter chosen, as for example $Ba_3Al_2O_6$, is ground in a mortar and pestle into a fine powder and a fine sieve used to separate large particles of $Ba_3Al_2O_6$ from small particles. The small particles of $Ba_3Al_2O_6$ are then coated by chemical vapor deposition with a metal such as iridium or osmium or rhodium or tungsten followed by iridium. The thickness of the coating is about 2–5 microns.

After the $Ba_3Al_2O_6$ particles are coated with the desired thickness of iridium or osmium or rhodium or tungsten followed by iridium, the particles are ready for impregnation. This is conveniently done by adding $BaO_2$ to them prior to impregnation in the weight ratio of about two parts by weight coated particles to one part by weight $BaO_2$. In the impregnation, nation, at a temperature above 480° C., the $BaO_2$ melts and the solid particles of $Ba_3Al_2O_6$ coated for example with iridium penetrate into the pores of the porous tungsten iridium billet provided that the coated particles are small enough in size. As the temperature during impregnation is increased, the $BaO_2$ liquid reacts with the tungsten in the porous billet to form $Ba_3WO_6$. Since the $BA_3Al_2O_6$ is coated with Ir, no reaction takes place between the $Ba_3Al_2O_6$ and the Ir. Reaction, however, occurs between the forming $Ba_3WO_6$ and the tungsten of the billet forming BaO which reacts with the iridium in the billet.

When the $Ba_3Al_2O_6$ particles are coated with tungsten and then with iridium, the $Ba_3Al_2O_6$ particles are coated with two chemical vapor disposition coats, first by tungsten and then by iridium. This allows use of the inside wall of the tungsten-iridium billet as well as the outside wall of the billet to react after the initial reaction takes place. The surface area of the reaction is increased by a reaction taking place between the $Ba_3Al_2O_6$ with the coated tungsten and on the outside after the $Ba_3Al_2O_6$ has reacted with the tungsten of the billet.

The method of impregnation of the invention gives more surface area than the tungsten-iridium billet by itself since the total contact surface area is the sum of the top of the surface area of the billet and the area of the pores in the billet. In this billet, the total surface of the active tungsten and iridium is the top of the surface of the billet, the surface area of the pores and the added area of the coated particles or the sum total of both sides of the coated particles. This gives rise to cathodes of high emission and lower operating temperatures. In fact, where the cathode is operated at temperatures from about 800° C. to about 950° C., a five fold increase in current density is obtained as compared to U.S. Pat. No. 4,818,480.

The method of coating the emitter, which is not part of the invention, can be by sputtering, chemical vapor deposition, or other chemical methods. A particularly desirable method is the decomposition of the metal carbonyl of tungsten, iridium, osmium, etc. via chemical vapor deposition since the temperature of decomposition is below 300° C. The use of a vibrator during the chemical vapor deposition process is desirable to obtain deposition on all sides of the emitter during the chemical reaction.

The porous billet can be tungsten, or tungsten-iridium or tungsten-osmium, or tungsten-rhodium, or tungsten-ruthenium with pores as large as possible, to give the desired surface area.

DESCRIPTION OF THE PREFERRED EMBODIMENT

A long life high current density cathode is made in the following manner. Tungsten and iridium powders are mixed in a weight ratio of about 65 weight percent tungsten to about 34 weight percent iridium. One percent by weight of zirconium hydride activator is added to the mixture and the mixture ball milled for about 8 hours. The ball milled mixture is then pressed into a billet at about 48,000 psi in a die and the billet then sintered at 1800 C for thirty minutes in dry hydrogen of less than −100 dewpoint. The billet is then backfilled with conper in dry hydrogen at 1150 C, the billet machined to the desired geometry, and the copper then removed by etching in nitric acid. The porous billet is then thoroughly rinsed in deionized water, methanol and then dried. The billet is then impregnated with a mixture of barium peroxide and the emitter, Ba Al O that has been first coated with tungsten and then coated with iridium as the impregnant by firing the billet in a dry hydrogen furnace at about 900 C for about 2 minutes. The billet is removed from the furnace after the furnace is cooled and loose particles of impregnant are removed from the billet using a jeweler's lathe and fine alumina cloth.

The resulting cathode is then mounted in a test vehicle and activated using standard matrix cathode activation procedures.

We wish it to be understood that we do not desire to be limited to the exact details of construction as described for obvious modification will occur to a person skilled in the art.

What is claimed is:

1. Method of making a long life high current density cathode suitable for operation in microwave devices from tungsten and iridium powders using a mixture of barium peroxide and a coated emitter as the impregnant, said method including the steps of:

(A) mixing the tungsten and iridium powders, (B) adding about 1 percent by weight of an activator to the mixture, (C) ball milling the mixture for about 8 hours, (D) pressing the ball milled mixture into a billet at about 48,000 psi in a die, (E) sintering the billet at about 1800° C. for about ½ hour in dry hydrogen of less than −100 dewpoint, (F) backfilling the billet with copper in dry hydrogen at about 1150°, (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with a mixture of fine sized particles of an emitter that has been coated with at least one metal selected from the group consisting of iridium, osmium, rhodium and tungsten followed by iridium and barium peroxide by firing the billet in a dry hydrogen furnace at a temperature at which the impregnant melts for about two minutes, (L) removing the billet from the furnace after the furnace is cooled, and (M) removing any loose pieces of impregnant from the billet.

2. Method of making a long life high current density cathode according to claim 1 wherein in Step (A) the tungsten and iridium powders are mixed in a weight ratio of about 60 weight percent tungsten to about 39 weight percent iridium.

3. Method of making a long life high current density cathode according to claim 2 wherein in step (B), the activator, is about 1 weight percent zirconium hydride.

4. Method according to claim 3 wherein the emitter is selected from the group consisting of $Ba_3Al_2O_6$, $Ba_3WO_6$, $4BaO/1CaO/Al_2O_3$ and $5BaO/1CaO/2Al_2O_3$.

5. Method according to claim 4 wherein the emitter is $Ba_3Al_2O_6$.

6. Method according to claim 4 wherein the emitter is $Ba_3WO_6$.

7. Method according to claim 4 wherein the emitter is $4BaO/1CaO/Al_2O_3$.

8. Method according to claim 4 wherein the emitter is $5BaO/1CaO/2Al_2O_3$.

9. Method according to claim 1 wherein in Step (K), the firing temperature is from about 800° C. to about 950° C.

10. Method of making a long life high current density cathode suitable for operation in microwave devices from tungsten and iridium powders using a mixture of barium peroxide and fine size particles of an emitter, $Ba_3Al_2O_6$, that has been first coated with tungsten and then coated with iridium as the impregnant, said method including the steps of:

(A) mixing the tungsten and iridium powders in a weight ratio of about 60 weight percent tungsten to about 39 weight percent iridium (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about ½ hour in dry hydrogen of less then −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen to about 1400° C. for about 15 minutes, (K) impregnating the billet with a mixture of barium peroxide and fine size particles of an emitter, $Ba_3Al_2O_6$, that has been first coated with tungsten and then coated with iridium as the impregnant by firing the billet in a dry hydrogen furnace at about 900° C. for about 2 minutes, (L) removing the billet from the furnace after the furnace is cooled, and (M) removing any loose pieces of impregnant from the billet.

* * * * *